US010796869B2

(12) United States Patent
Monka et al.

(10) Patent No.: US 10,796,869 B2
(45) Date of Patent: Oct. 6, 2020

(54) ELECTRICAL SWITCHING DEVICE

(71) Applicant: SIEMENS AKTIENGESELLSCHAFT, Munich (DE)

(72) Inventors: Roland Monka, Berlin (DE); Christian Dengler, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/473,143

(22) PCT Filed: Nov. 23, 2017

(86) PCT No.: PCT/EP2017/080177
§ 371 (c)(1),
(2) Date: Jun. 24, 2019

(87) PCT Pub. No.: WO2018/114204
PCT Pub. Date: Jun. 28, 2018

(65) Prior Publication Data

US 2019/0362917 A1 Nov. 28, 2019

(30) Foreign Application Priority Data

Dec. 22, 2016 (DE) ..... 10 2016 226 034

(51) Int. Cl.
*H01H 33/70* (2006.01)

(52) U.S. Cl.
CPC .... *H01H 33/7084* (2013.01); *H01H 33/7023* (2013.01); *H01H 33/7038* (2013.01)

(58) Field of Classification Search
CPC ..... H01H 33/7084; H01H 33/7023; H01H 33/7038; H01H 1/385
See application file for complete search history.

(56) References Cited

U.S. PATENT DOCUMENTS 2,987,596 A 6/1961 Forwald
2,997,564 A 8/1961 Baker
(Continued)

FOREIGN PATENT DOCUMENTS

DE 1150428 B 6/1963
DE 1205605 B 11/1965
(Continued)

OTHER PUBLICATIONS

PCT International Search Report and Written Opinion of International Searching Authority dated Feb. 27, 2018 corresponding to PCT international Application No. PCT/EP 2017/080177 filed Nov. 23, 2017.

*Primary Examiner* — Truc T Nguyen
(74) *Attorney, Agent, or Firm* — Laurence Greenberg; Werner Stemer; Ralph Locher

(57) ABSTRACT

An electrical switching device includes a first switching contact piece and a second switching contact piece. The switching contact pieces can be displaced in relation to each other. The first switching contact piece is surrounded by a fluid flow guiding device. An enveloping contour of a flow duct, disposed between the fluid flow guiding device and the first switching contact piece, is greater at its end facing the second switching contact piece than an enveloping contour of the first switching contact piece at its end facing the second switching contact piece.

15 Claims, 4 Drawing Sheets

(56) References Cited

U.S. PATENT DOCUMENTS

| | | | | |
|---|---|---|---|---|
| 3,396,253 | A | 8/1968 | Schubert et al. | |
| 4,628,164 | A * | 12/1986 | Talpo | H01H 33/12 218/65 |
| 2015/0014280 | A1* | 1/2015 | Cernat | H01H 33/72 218/157 |
| 2015/0364280 | A1* | 12/2015 | Cernat | H01H 33/42 218/146 |
| 2015/0371797 | A1* | 12/2015 | Cernat | H01H 1/385 218/53 |
| 2017/0084412 | A1* | 3/2017 | Bujotzek | H01H 1/385 |
| 2019/0035579 | A1* | 1/2019 | Pisu | H01H 33/74 |

FOREIGN PATENT DOCUMENTS

| | | | |
|---|---|---|---|
| DE | 6603028 | | 8/1969 |
| DE | 3142183 | A1 | 4/1983 |
| DE | 102007031948 | A1 | 1/2009 |
| FR | 913640 | A | 9/1946 |
| JP | 2005243465 | A | 9/2005 |
| KR | 1020150001499 | A | 1/2015 |

* cited by examiner

ELECTRICAL SWITCHING DEVICE

BACKGROUND OF THE INVENTION

Field of the Invention

The invention relates to an electrical switching device having a first switching contact piece and a second switching contact piece, wherein the switching contact pieces can be moved relative to one another and the first switching contact piece is surrounded by a fluid flow guiding device.

An electrical switching device of this kind is known, for example, from published specification DE 31 42 183 A1. The switching device in said document has a first switching contact piece and a second switching contact piece which can be moved relative to one another. The first switching contact piece is arranged on a carrier and surrounded by a fluid flow guiding device. The fluid flow guiding device causes liquid to wash around the first switching contact piece and forms a bottleneck in front of an end side of the first switching contact piece. An arc is blown by a fluid flow in the bottleneck of the fluid flow guiding device. Blowing the arc is not considered to be optimal. In particular, there is a risk of large proportions of the fluid flow flowing past the arc at a distance from said arc.

SUMMARY OF THE INVENTION

Therefore, the object of the invention is to specify an electrical switching device which allows an arc to be subjected to flow in an improved manner.

According to the invention, this object is achieved in the case of an electrical switching device of the kind mentioned at the outset in that the fluid flow guiding device surrounds the lateral surface side of the first switching contact piece in such a way that an enveloping contour of a flow duct which is delimited between the fluid flow guiding device and the first switching contact piece, at least at its end which faces the second switching contact piece, is larger than the enveloping contour of the first switching contact piece at its end which faces the second switching contact piece.

An electrical switching device serves to interrupt a current path. In this case, the current path when live can carry an electric current which is likewise to be interrupted when the electrical current path is interrupted. Switching contact pieces which can be moved relative to one another and between which an isolating gap is produced during a disconnection or opening process can be used in order to interrupt a current path. The switching contact pieces can be arranged with the end sides opposite one another and can be displaced relative to one another along a longitudinal axis. The switching contact pieces are exposed to an electrically insulating fluid which also flows into the isolating gap when the isolating gap is produced. The switching contact pieces and, respectively, the isolating gap can be exposed to a fluid flow in a targeted manner to this end. An optionally flowing electric current can continue in the form of an arc through the isolating gap within a fluid when the switching contacts are isolated from one another. An arc of this kind prevents direct interruption of an electric current with DC isolation of the switching contact pieces. Accordingly, an arc of this kind is generally undesirable and as far as possible should not occur at all or should be reliably quenched.

An electrical switching device can be, for example, a load switch, an isolating switch, a grounding switch, a circuit breaker or a similar switching device. Contact-connection between the switching contact pieces should take place at a relative speed of approximately 3.5 m/s to approximately 5 m/s, in particular approximately 4.5 m/s. Isolation of the switching contact pieces should take place at a relative speed of approximately 0.7 m/s to approximately 5 m/s, in particular at approximately 1.4 m/s. A fluid flow can be directed by means of a fluid flow guiding device. Therefore, it is possible, for example, to subject specific regions of an isolating gap, which is formed during a switching process between the two switching contact pieces, to flow in a particularly intensive manner by means of the fluid flow guiding device. For example, a fluid flow can flow around the lateral surface side of the isolating gap and form a flow barrier. Suitable fluids include, for example, electrically insulating fluids in the gas or liquid state such as, for example, nitrogen, carbon dioxide, sulfur hexafluoride, fluoroketones, fluoronitriles, fluorinated peroxides or other substances which have an adequate dielectric strength. The switching contact pieces can preferably be separated from one another or moved closer to one another along a defined path with a specific movement profile. The fluid flow guiding device can advantageously surround the first switching contact piece. That is to say, the first switching contact piece is covered or overlapped on an outer lateral surface, at least in sections, by the fluid flow guiding device. The fluid flow guiding device can advantageously enclose, for example, the entire outer lateral surface side of the first switching contact piece, for example in an annular/tubular manner. In this case, the fluid flow guiding device can have closed flow surfaces. However, provision can also be made for flow surfaces to have apertures, so that eddying of a flowing fluid is promoted. The first switching contact piece can preferably be surrounded by the fluid flow guiding device in a concentric manner. To this end, both the first switching contact piece and the fluid flow guiding device can each be oriented or formed coaxially substantially in relation to a longitudinal axis. The fluid flow guiding device can be formed, for example, in a tubular manner at least in sections and can be oriented coaxially in relation to a contact piece. A flow duct can be delimited, for example, on the inner lateral surface side by the first switching contact piece and on the outer lateral surface side by the fluid flow guiding device. An enveloping contour of the flow duct can be defined by an outer cross section of the flow duct. In a flow duct with a substantially circular cross section, the enveloping contour is defined by the outer diameter of the flow duct. The enveloping contour of the first switching contact piece can be defined by the outer cross section of the first switching contact piece.

The enveloping contour of the flow duct can completely shadow the enveloping contour of the first switching contact piece. The flow duct can vary in cross section due to a profiling of the fluid flow guiding device which delimits it or of the first switching contact piece. A buildup or release of a fluid flow within the flow duct can be produced by a profiling, so that a fluid flow can be influenced.

By way of forming the enveloping contour of the flow duct with a larger cross section than the enveloping contour of the first switching contact piece, free access to the first switching contact piece is provided at the end side (toward the second switching contact piece). In particular, provision can be made for nozzle-like constrictions of the fluid flow guiding device in front of the first switching contact piece, that is to say in front of the free end of the first switching contact piece which faces the second switching contact piece, to be avoided. Therefore, complete access to the end side of the first switching contact piece from a direction perpendicular to the end side can be possible. In this way, there is a large region for receiving roots of the arc at the end side, as a result of which erosion is distributed between different points of the first switching contact piece, so that it is possible for a fluid to flow or wash widely around an arc. Furthermore, it is possible for an electrically insulating fluid to wash extensively around the isolating gap in this way. Therefore, a fluid can wash around an arc in the isolating gap on all sides. The fluid flow guiding device should have an adequate temperature resistance in order to be able to withstand an action of heat produced by an arc.

The fluid flow guiding device can have an electrically insulating effect. The fluid flow guiding device can have an electrically conductive effect. The fluid flow guiding device can comprise, for example, a metal, an insulating material, for example PTFE, etc.

A further advantageous refinement can make provision for an outer lateral surface of the first switching contact piece, at its end which faces the second switching contact piece, to be accessible from the radial direction.

Radial access to the first switching contact piece renders it possible to use the outer lateral surface of the first switching contact piece in order to provide there, for example, contact-making points for contact-connection with the second switching contact piece. Therefore, it is possible, for example, for the second switching contact piece to be pushed onto the first switching contact piece on the outer lateral surface side and for contact to be made in the region of an outer lateral surface of the first switching contact piece. Accordingly, in the case of an arrangement according to the invention of a flow duct, fluid can wash widely around the contact-making points, as a result of which an arc can be coated by the fluid flow. Therefore, breaking out of the arc is counteracted and efficient cooling of the arc is produced. In order to gain radial access to an outer lateral surface of the first switching contact piece, the flow duct can, for example, expand (for example funnel-like increase in cross section), in order to allow a fluid flow to fan out.

A further advantageous refinement can make provision for the first switching contact piece, by way of its end which faces the second switching contact piece, to protrude beyond the fluid flow guiding device.

By way of the first switching contact piece protruding or projecting beyond that (out of that) end of the flow guiding device which faces the second switching contact piece, a free end of the first switching contact piece is formed, which free end is free of overlapping by the fluid flow guiding device in the radial direction. Therefore, a mouth opening of the flow duct is drawn back behind the free end of the first switching contact piece, so that a fluid flow can exit from the lateral surface side of the first switching contact piece. The mouth opening and the end-side free end (that end which faces the second switching contact piece) of the first switching contact piece are at an axial distance from one another. It is possible to arrange contact-making points for the second switching contact piece on the lateral surface side of the first switching contact piece, so that, in the event of contact isolation, these contact-making regions can be subjected to flow from the flow duct and electrically insulating fluid is caused to wash in a hollow-cylindrical manner (in the manner of a jacket) around the isolating gap between the two switching contact pieces.

A further advantageous refinement can make provision for the first switching contact piece to be a bolt-like switching contact piece.

A bolt-like switching contact piece constitutes a mechanically resistant structure which has a high current-carrying capacity. In a bolt-like contact piece, contact-making points are usually arranged on the outer lateral surface side, that is to say in the region which is surrounded by a fluid flow guiding device. Owing to this structure, it is possible to use the outer lateral surface of the first contact piece firstly to delimit a flow duct and secondly to position contact-making points, as a result of which it is rendered possible to subject the contact-making points and therefore possible arc roots to flow in an improved manner. The regions of the first switching contact piece which are surrounded by the fluid flow guiding device and the contact-making points on the first switching contact piece can be arranged in a manner axially offset in relation to one another.

Provision can advantageously further be made for a fluid flow which flows around a bolt-like first switching contact piece to be guided by the fluid flow guiding device to a bushing-like second switching contact piece.

A fluid flow can advantageously be guided from the bolt-like first switching contact piece to a bushing-like second contact piece. Owing to an outflow of fluid, for example out of a mouth opening of a flow duct which extends around the first switching contact piece in the form of an annular gap, it is possible to surround an isolating gap from the bolt-like switching contact piece to the bushing-like switching contact piece with a jacket of flowing fluid and to allow an arc to burn within this fluid-enclosed isolating gap. Owing to the arc being encased, it can be fully cooled and blown irrespective of its position. Therefore, displacement of fluid of a fluid flow in edge regions of the isolating gap can be counteracted.

A further advantageous refinement can make provision for the fluid flow guiding device and the first switching contact piece to be movable.

Both the fluid flow guiding device and the first switching contact piece can each be arranged in a movable manner. In this case, the fluid flow guiding device and the first switching contact piece can be movable relative to one another. However, provision can also be made for the first switching contact piece and the fluid flow guiding device to be jointly movable. Owing to an ability to move the fluid flow guiding device and the first switching contact piece, it is possible in a simple manner to generate a fluid flow on account of a movement and to concentrate this fluid flow in a flow duct.

A further advantageous refinement can make provision for the fluid flow guiding device to be arranged at a fixed angle in relation to the first switching contact piece.

Owing to connection of the first switching contact piece and the fluid flow guiding device at a fixed angle, the relative position of the two elements in relation to one another is fixed. Therefore, the mouth opening or the position of the mouth opening of a flow duct, which is delimited by the fluid flow guiding device and the first switching contact piece, is also fixed. Accordingly, the fluid flow guiding device can sit, for example, on the first switching contact piece. For example, the fluid flow guiding device can sit on the outer lateral surface side of a bolt-like first switching contact piece. For example, the fluid flow guiding device can be connected in a force-fitting manner to the first switching contact piece. A fixed-angle combination of the first switching contact piece and the fluid flow guiding device can be arranged in a movable manner.

A further advantageous refinement can make provision for the first switching contact piece to be of hollow design at least in sections.

A configuration of the first switching contact piece such that it is hollow at least in sections renders it possible to reduce the mass of the switching contact piece. For example, a bolt-like switching contact piece which is of hollow design at least in sections can be formed in this way. Accordingly, particularly in the case of relatively high-frequency voltages or flows in which a displacement of flows in edge regions of an electrical conductor can be recorded on account of the skin effect, the inefficient use of material on the first switching contact piece can be dispensed with. Therefore, it is possible, for example, to use a first switching contact piece which is hollow-cylindrical at least in sections and interacts with a fluid flow guiding device. The first switching contact piece can have, for example on the end side, a hollow configuration, as a result of which it is possible to stabilize the first switching contact piece in its position by way of the end side bearing, for example, against a guide element or a centering element and vibration being prevented in this way. Furthermore, a hollow section of the first switching contact piece can also be used in order to guide a fluid flow, for example the same fluid flow or at least parts of the same fluid flow which is guided in the flow duct between the fluid flow guiding device and the first switching contact piece.

A further advantageous refinement can make provision for a fluid flow to be guided both inside and outside the first switching contact piece.

A fluid flow can extend both inside and outside the first switching contact piece. In this case, provision can be made for the fluid flow to be guided out of the interior of the first switching contact piece into the flow duct on an outer lateral surface of the first switching contact piece, so that the first switching contact piece is subjected to flow both from the inside and from the outside at least in sections, as a result of which, in addition to an arc being subjected to flow, the fluid flow can also cool the first switching contact piece. For example, a first switching contact piece which is of hollow design at least in sections can use a cavity which is located in its interior in order to guide a fluid flow.

A further advantageous refinement can make provision for the fluid flow to traverse a wall of the first switching contact piece.

A wall can have, for example, a communication opening in order to allow a fluid flow to pass from the interior of the first switching contact piece into a flow duct between the fluid flow guiding device and the first switching contact piece. As a result, the flow duct can be fed from the interior of the first switching contact piece. An axial offset of a fluid flow which is guided on an inner wall and an outer wall of the first switching contact piece can advantageously be provided. Therefore, it is possible to guide compressed fluid in the direction of the isolating gap, for example in the interior of the first switching contact piece, for example in a compression device, and to this end to conduct the fluid flow outward on the lateral surface side through a communication opening. There, the outer lateral surface side of the first switching contact piece can be subjected to laminar flow by means of the fluid flow guiding device. After the fluid exits from the flow duct, a lateral surface side of the isolating gap can be surrounded.

A further advantageous refinement makes provision for a flow duct with a substantially ring-like cross section to be delimited by the first switching contact piece and the fluid flow guiding device.

The flow duct between the first switching contact piece and the fluid flow guiding device can have a substantially ring-like cross section. In this case, the ring-like cross section can be constant at least in sections. The cross section of the flow duct should remain constant particularly in the region of the mouth opening, so that the flowing fluid is calmed and laminarized before a fluid flow exits through the mouth opening of the flow duct. In this region, the flow duct should have a substantially hollow-cylindrical profile with a constant cross section. However, provision can also be made for the cross section of the flow duct to be increased in size, for example, for generating lateral surface-side access to the first switching contact piece at its end which faces the second switching contact piece, so that, for example, a funnel-like diffuser action is produced, as a result of which dispersal of the fluid flow in the region of the mouth opening is increased and the flow rate is reduced. In this region, it is then additionally possible to be able to access the lateral surface-side region of the free end of the first switching contact piece from the radial direction.

A further advantageous refinement can make provision for an opening in a shielding hood of the second switching contact piece to be blocked by means of the fluid flow guiding device in the state in which the switching contact pieces are contact-connected.

The second switching contact piece can be surrounded by a shielding hood for the purpose of dielectric shielding, wherein the second switching contact piece is accessible via an opening in the shielding hood. It is possible to block the opening in the shielding hood by means of the fluid flow guiding device in the connected state, that is to say when the first and the second switching contact piece are in the contact-connected state. In this case, mechanical blocking is firstly possible by way of fluid flows being prevented from undesirably passing through the shielding hood. Secondly, dielectric blocking of the opening in the shielding hood can also be performed by way of electric fields being homogenized by dielectric "closure". If required, the fluid flow guiding device can have an electrically insulating material and/or an electrically conductive material. Provision can be made for the fluid flow guiding device to have at least an electrically insulating effect in sections and for other sections to be of electrically conductive design. For example, surface regions can be designed in an electrically conductive manner by means of a coating or an electrically insulating material can be doped by means of electrically conductive additives.

Provision can advantageously further be made for an erosion-resistant region of the first switching contact piece to be free of radial overlapping by the fluid flow guiding device.

The first switching contact piece can be designed as a so-called power contact piece and serve to guide an arc. In order to provide adequate resistance to the arc, at least sections of the first switching contact piece are to be formed from an erosion-resistant material, so that there is an erosion-resistant region on the first switching contact piece. In this case, the erosion-resistant region of the first switching contact piece should be free of radial overlapping by a fluid flow guiding device. As a result, it is possible to allow roots of a burning arc to migrate over the erosion-resistant region and in this way to distribute the eroding energy of said arc over a large surface region and, in the process, to perform suitable application of flow by means of a fluid flow guiding device. In particular, the arc can also be rooted on the outer lateral surface side of a region of the first switching contact piece that is not radially overlapped. As a result, thermal loading of the fluid flow guiding device is reduced. Furthermore, the erosion-resistant region can be exposed to a fluid flow, so that the arc within the isolating gap can be restricted and compacted by the fluid flow. The erosion-resistant region can delimit an isolating gap.

A further advantageous refinement can make provision for the switching contact pieces to be able to be displaced relative to one another with their end sides situated opposite one another.

Switching contact pieces can have their end sides situated opposite one another. In particular, switching contact pieces which have their end sides situated opposite one another can be arranged so as to be able to be displaced axially relative to one another, so that a linear relative movement between the two switching contact pieces is to be caused in order to produce an isolating gap. For example, the switching contact pieces can be designed as bolts and contrasting bushings, so that a bolt can move into/out of a bushing by means of a linear movement. Owing to a linear movement, the formation of a flow jacket around the isolating gap is further promoted since a flow which runs parallel to the relative movement of the two switching contact pieces can be continuously produced around the isolating gap in the form of a jacket. Deflection or transverse guidance of a free-flowing fluid flow is therefore not required. This additionally assists in blocking and constricting an arc within an isolating gap.

An advantageous refinement can make provision for the bushing-like second switching contact piece to have a centering pin in a bushing opening.

A centering pin in a bushing opening allows movement of a bolt into and, respectively, out of a bushing to be assisted. Oscillation or vibration of the bolt can be prevented by way of the bolt moving on the centering pin. To this end, the bolt can be, for example, of hollow design at the end side, so that the centering pin can protrude into the bolt. Owing to centering of this kind, exact contact-connection and, respectively, isolation of the switching contact pieces can be assisted. In particular, elastically deformable contact elements of the first and, respectively, of the second switching contact piece are protected against excessive mechanical loading by twisting or other deflections. Provision can be made for no contact to be made with the centering pin during normal operation. To this end, a corresponding fit with play can be provided between the centering pin and the first switching contact piece. Therefore, vibration within the scope of fitting is permissible. Only relatively large vibrations are limited. Provision can be made for the centering pin to act as part of the contact system. However, provision can also be made for the centering pin to perform only a mechanical function and not be involved in electrical functioning of the contact system.

BRIEF DESCRIPTION OF THE SEVERAL VIEWS OF THE DRAWING

An exemplary embodiment of the invention will be described in more detail in the text which follows and schematically shown in a drawing below. In said drawing

DESCRIPTION OF THE INVENTION

Figure 1:
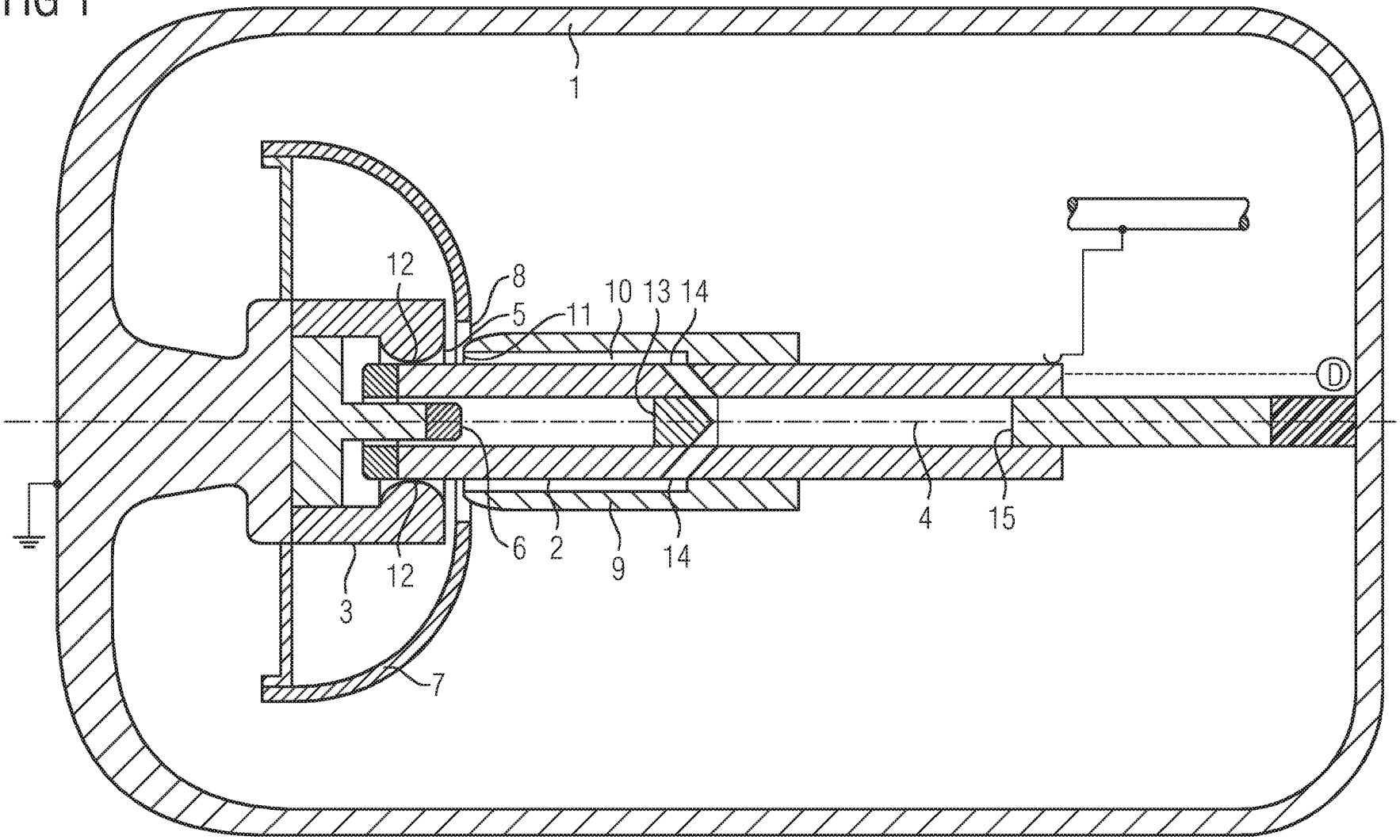
FIG. 1 shows an electrical switching device in the connected state.
Figure 2:
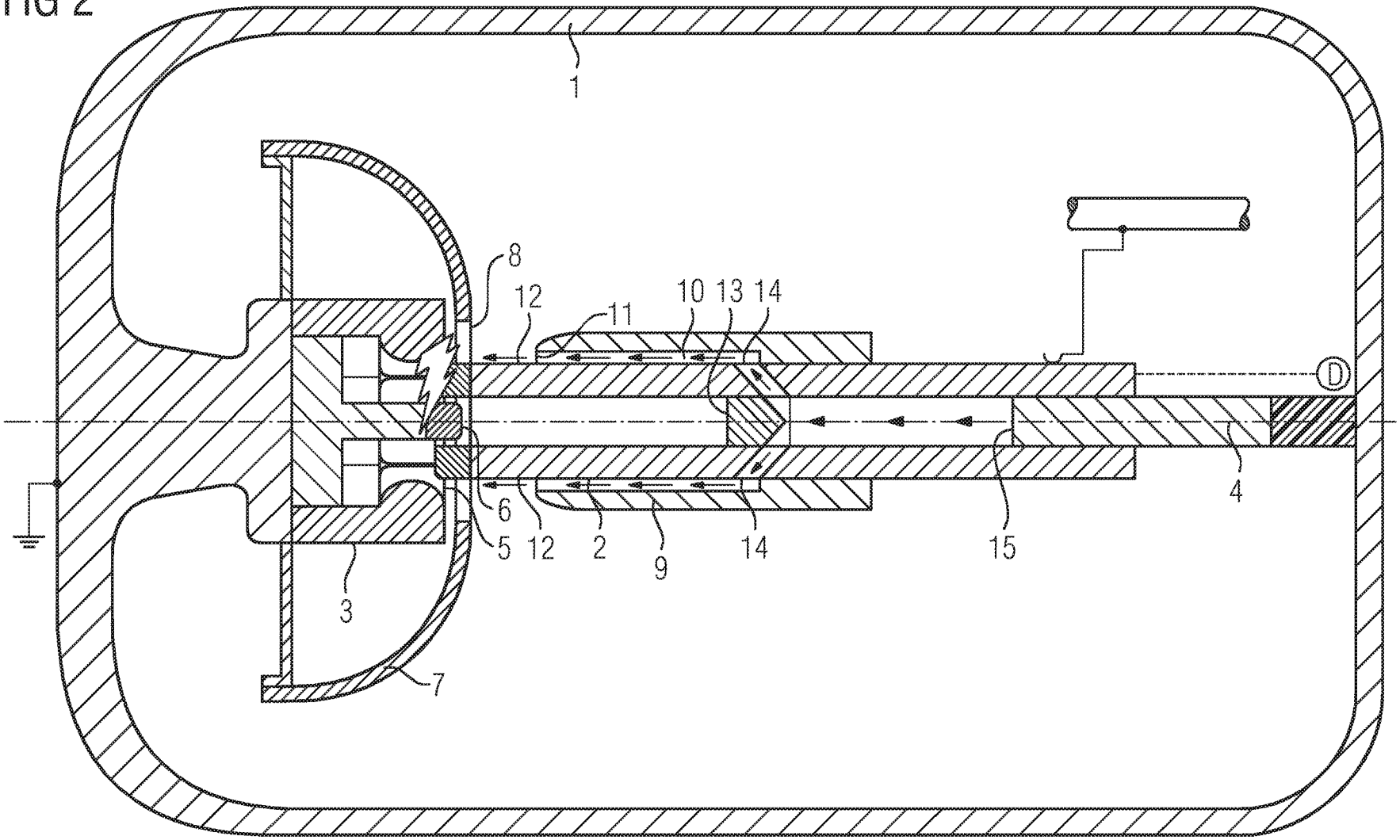
FIG. 2 shows the electrical switching device known from FIG. 1 at the beginning of a disconnection movement.
Figure 3:
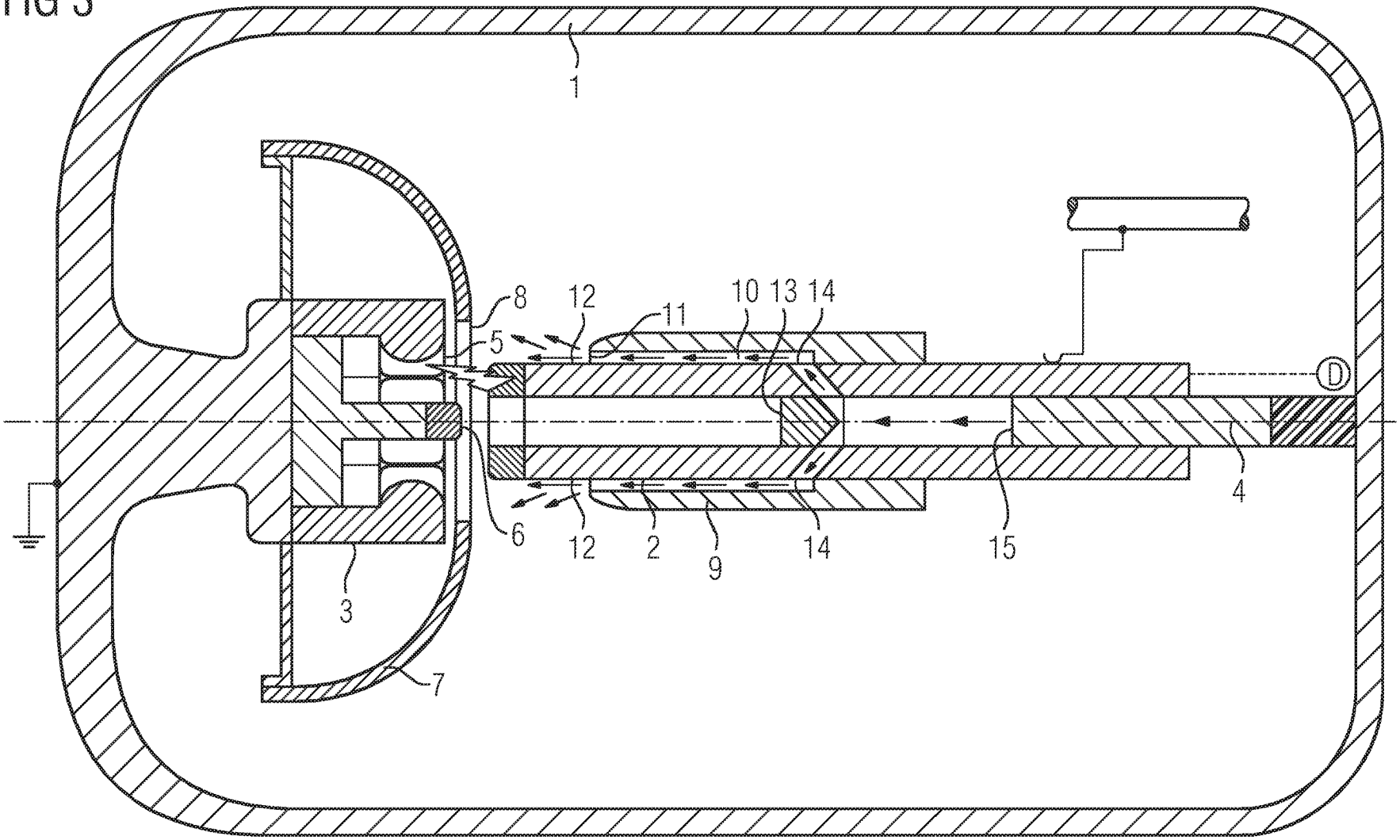
FIG. 3 shows the electrical switching device known from FIGS. 1 and 2 at an elapsed time of a disconnection movement.
Figure 4:
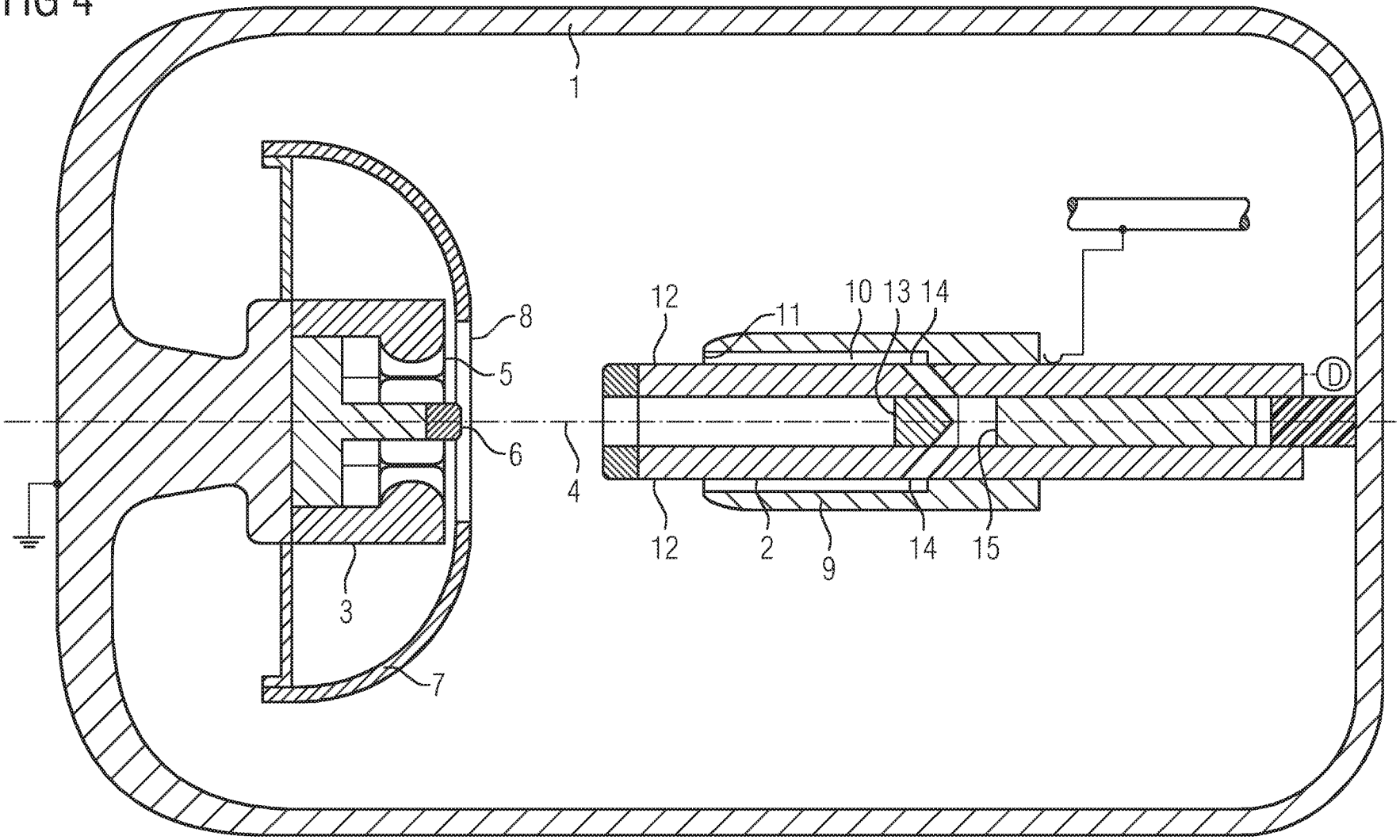
FIG. 4 shows the electrical switching device known from FIGS. 1 to 3 in the disconnected state.

FIG. 1 shows a cross section through an electrical switching device. The basic structure of the electrical switching device will be described with reference to FIG. 1 to begin with.

The electrical switching device shown in FIG. 1 is a so-called grounding switch with the aid of which ground potential can be applied to a busbar section which serves to transmit current. The electrical switching device is embodied as a pressurized fluid-insulated switching device. To this end, the electrical switching device has a housing 1. The housing 1 is designed as a fluid-tight encapsulation, so that an electrically insulating fluid can be enclosed in the interior. The housing 1 prevents the electrically insulating fluid from evaporating. The housing 1 is designed, for example, as a metal housing 1 which carries ground potential, wherein the electrically insulating fluid which is enclosed in the interior of the housing 1 is pressurized. As a result, the electrical insulation resistance of the electrically insulating fluid is additionally improved. The busbar section, which can be connected to ground by means of the electrical switching device, is likewise arranged within the housing 1. However, provision can also be made for the busbar section which can be connected to ground to be arranged outside the housing 1 or in an adjoining housing in a separate fluid chamber, wherein only electrical contact-connection to the electrical switching device is provided.

The electrical switching device has a first switching contact piece 2 and a second switching contact piece 3. The first switching contact piece 2 is designed as a bolt-like switching contact piece 2. The second switching contact piece 3 is designed as a bushing-like switching contact piece 3. The second switching contact piece 3 is mounted on the housing 1 and is electrically contact-connected to said housing, so that the ground potential of the housing 1 is also transmitted to the second switching contact piece 3. The second switching contact piece 3 has, for the purpose of forming a bushing, a plurality of contact fingers which are arranged in a manner radially distributed around a longitudinal axis 4, so that a bushing opening 5 is delimited. A centering pin 6 is arranged in the center of the bushing opening 5. The centering pin 6 carries the same electrical potential as the contact fingers which delimit the bushing opening 5. In the direction of the longitudinal axis 4, the centering pin 6 projects beyond the contact fingers which delimit the bushing opening 5. The centering pin 6 is equipped with an erosion-resistant tip at its end which protrudes beyond the bushing opening 5. The centering pin 6 is connected at a fixed angle to the housing 1 by means of a base of the second switching contact piece 3 and is electrically contact-connected to said housing.

The second contact piece 3 is arranged in the shielding shadow of a shielding hood 7. In the present case, the shielding hood 7 is designed substantially in the shape of a spherical cap and is formed from an electrically conductive material. The shielding hood 7 carries the same electrical potential as the housing 1. The shielding hood 7 is mounted on the housing 1 together with the second switching contact piece 3. The shielding hood 7 has an opening 8. Access to the bushing opening 5 of the second switching contact piece 3 is rendered possible via the opening 8.

The drivable and therefore movable first switching contact piece 2 is arranged opposite the end side of the bushing opening 5. The first switching contact piece 2 is shaped in a substantially hollow-cylindrical manner. A fluid flow guiding device 9 is seated on the outer lateral surface side of the first switching contact piece 2. The fluid flow guiding device 9 is connected at a fixed angle to the first switching contact piece 2. The fluid flow guiding device 9 further has an inner lateral surface which is positioned at a distance from an outer lateral surface of the first switching contact piece 2, so that a flow duct 10 is formed between the outer lateral surface of the first switching contact piece 2 and the inner lateral surface of the fluid flow guiding device 9. In this case, the flow duct 10 has a substantially circular cross section which substantially has a constant cross section over its extent, so that the flow duct 10, which is delimited by the outer lateral surface of the first switching contact piece 2 and the inner lateral surface of the fluid flow guiding device 9, substantially has a hollow-cylindrical structure. The flow duct 10 has a mouth opening 11 at the free end of the first switching contact piece 2 or at that end which faces the second switching contact piece 3. The mouth opening 11 in turn has a ring-like cross section which has a substantially identical cross section to the profile of the flow duct 10. In this case, the fluid flow guiding device 9 of substantially cylindrical configuration is positioned on the first switching contact piece 2 in such a way that the first switching contact piece 2 protrudes beyond the fluid flow guiding device 9 in the direction of the second switching contact piece 3 (by way of its free end). As a result, the free end of the first switching contact piece 2, which free end faces the second switching contact piece 3, is free of radial overlapping by the fluid flow guiding device 9. Accordingly, radial access to the free end, that is to say to that end of the first switching contact piece 2 which faces the second switching contact piece 3, is rendered possible. Accordingly, contact-making points 12 at which the contact fingers of the second switching contact piece 3, which contact fingers delimit the bushing opening 5, come into contact are arranged on the outer lateral surface side of the first switching contact piece 2. In this case, the end side of the first switching contact piece 2 is formed by an erosion-resistant tip which, as an erosion-resistant region of the first switching contact piece 2, is free of radial overlapping by the fluid flow guiding device 9.

On account of the hollow-cylindrical configuration of the first switching contact piece 2, that end of the first switching contact piece 2 which faces the second switching contact piece 3 on the end side is provided in the center with a recess into which the centering pin 6 protrudes in the connected state. Therefore, the centering pin 6 can stabilize a linear displacement of the first switching contact piece 2 relative to the second switching contact piece 3, in particular when it is moved into the bushing opening 5 of the second switching contact piece 3. The central recess within the first switching contact piece 2 is blocked by a barrier 13 which delimits the insertion depth of the centering pin 6. Communication openings 14 pass through the circumferential region of a wall of the first switching contact piece 2 on that side of the barrier 13 which is averted from the second switching contact piece 3. The communication openings 14 in the wall of the hollow-cylindrical first switching contact piece 2 allow communication between a hollow space in the interior of the first switching contact piece 2 and the flow duct 10. In this case, a piston 15 which can move relative to the first switching contact piece 2 is arranged in the interior of the first switching contact piece 2. For example, the piston 15 can be arranged fixed in position in relation to the housing 1, whereas the first switching contact piece 2 can be arranged such that it can move in relation to the housing 1 and therefore such that it can move in relation to the piston 15. Connection and disconnection of the electrical switching device can be performed by driving the first switching contact piece 2 by means of a drive device. In this case, the piston 15 sits in a dimensionally complementary manner in the recess of the hollow first switching contact piece 2.

A disconnection process, that is to say breaking of a ground connection to the busbar section, is intended to be described with reference to FIGS. 1, 2, 3 and 4. In this case, FIG. 1 initially illustrates the connected state of the first and the second switching contact piece 2, 3. That is to say, the first switching contact piece 2 is initially DC-connected to the second switching contact piece 3, so that the ground potential of the housing 1 is transmitted by means of the second switching contact piece 3 to the first switching contact piece 2 and from there to the grounded busbar section. In the event of a disconnection process, a movement is exerted on the first switching contact piece 2. This linear movement of the first switching contact piece 2 takes place in such a way that the first switching contact piece 2 is moved away from the second switching contact piece 3. This results in a reduction in the volume of the recess, which volume is present between the piston 15 and the barrier 13, in the interior of the first switching contact piece 2, as a result of which an excess pressure is produced in the interior of the first switching contact piece 2 in the electrically insulating fluid contained in said interior. In a manner driven by the excess pressure, electrically insulating fluid, which was previously arranged in the interior of the first switching contact piece 2, overflows via the communication openings 14 into the flow duct 10. DC-isolation of the first switching contact piece 2 from the contact fingers, which delimit the bushing opening 5, can lead to an arc being produced. This can be caused, for example, by charging phenomena on the first switching contact piece 2 or on the busbar current section. In the present case, the centering pin 6 is dimensioned in such a way that an electrical contact-connection is not produced due to a direct connection between the centering pin 6 and the second switching contact piece 2 and the first switching contact piece 2 is secured in position only in the event of relatively large vibrations or oscillations of said first switching contact piece. Accordingly, an arc initially extends between the erosion-resistant section of the first switching contact piece 2 and one or more contact fingers which delimit the bushing opening. However, provision can also be made for an arc to be struck at the root between the first switching contact piece 2 and the centering pin 6, in particular at the erosion-resistant sections thereof. On account of the contact overlap of the first and the second switching contact piece 2, 3 (see position of the contact-making points 12) on the lateral surface of the first switching contact piece 2, compression of electrically insulating fluid due to the relative movement of the piston 15 and also the first switching contact piece 2 begins as early as before DC isolation. At the start of the compression, the first and the second switching contact piece 2, 3 are still in electrically conductive contact. Only the position of the contact-making points 12 on the first switching contact piece 2 has shifted. As a result, there is already a continuous application of fluid, which flows out of the flow duct 10, at the time at which the first and the second switching contact piece 2, 3 are DC-isolated. DC isolation of the first and the second switching contact piece 2, 3 can result in an arc being produced (cf. FIG. 2). Application of fluid to the isolating gap between the first and the second switching contact piece 2, 3 has already started at this time, and therefore a striking arc is surrounded by a fluid which is already flowing. As the first switching contact piece 2 moves further away from the second switching contact piece 3 (cf. FIG. 3), fluid exits from the mouth opening 11 of the flow duct 10 with increasing dispersal. This occurs, in particular, since the fluid flow is subject to reduced directivity as the distance between the first switching contact piece 2 and the second switching contact piece 3 increases and therefore also as the distance between the mouth opening 11 and the second switching contact piece 3 increases. As the distance between the first and the second switching contact piece 2, 3 increases, the distance which is to be bridged by an arc increases. In addition to this increasing distance, the arc is blown and therefore cooled and erosion products are moved away from the isolating gap. The conditions for burning of the arc become increasingly worse. Furthermore, particularly when used in isolating or grounding switches, there is a reduction in charges, which drive the arc, across the arc. The arc is quenched. When the arc is quenched, the first switching contact piece 2 can be moved further away from the second switching contact piece 3. The arc is quenched when the end positions (cf. FIG. 4) of the first and the second switching contact piece 2, 3 are reached, that is to say the first and the second switching contact piece 2, 3 are at rest.

In the event of a connection process, the second switching contact piece 3 is moved closer to the first switching contact piece 2. When the connection position of the first and the second switching contact piece 2, 3 is reached (cf. FIG. 1), the recess for receiving a fluid, which recess is located in the interior of the first switching contact piece 2, is filled with a quantity of fluid, so that disconnection can take place once again with application of an electrically insulating fluid to a possibly striking arc.

The invention claimed is:

1. An electrical switching device, comprising:

a first switching contact piece and a second switching contact piece, said switching contact pieces being movable relative to one another, said first switching contact piece having a lateral surface side and an enveloping contour with an end facing said second switching contact piece;

a fluid flow guiding device surrounding said lateral surface side of said first switching contact piece and forming a flow duct delimited between said fluid flow guiding device and said first switching contact piece, said flow duct having an enveloping contour with an end facing said second switching contact piece; and at least said end of said enveloping contour of said flow duct facing said second switching contact piece, being larger than said end of said enveloping contour of said first switching contact piece facing said second switching contact piece.

2. The electrical switching device according to claim 1, wherein said first switching contact piece has an outer lateral surface and an end facing said second switching contact piece, said outer lateral surface of said first switching contact piece at said end facing said second switching contact piece being accessible from a radial direction.

3. The electrical switching device according to claim 1, wherein said first switching contact piece has an end facing said second switching contact piece and protruding beyond said fluid flow guiding device.

4. The electrical switching device according to claim 1, wherein said first switching contact piece is a bolt-shaped switching contact piece.

5. The electrical switching device according to claim 1, wherein said first switching contact piece is bolt-shaped, said second switching contact piece is bushing-shaped, and said fluid flow guiding device guides a fluid flow around said bolt-shaped first switching contact piece to said bushing-shaped second switching contact piece.

6. The electrical switching device according to claim 1, wherein said fluid flow guiding device and said first switching contact piece are movable.

7. The electrical switching device according to claim 1, wherein said fluid flow guiding device is disposed at a fixed angle relative to said first switching contact piece.

8. The electrical switching device according to claim 1, wherein said first switching contact piece is hollow at least in sections.

9. The electrical switching device according to claim 1, wherein a fluid flow is guided both inside and outside said first switching contact piece.

10. The electrical switching device according to claim 1, wherein a fluid flow traverses a wall of said first switching contact piece.

11. The electrical switching device according to claim 1, wherein said flow duct delimited by said first switching contact piece and said fluid flow guiding device has a substantially ring-shaped cross section.

12. The electrical switching device according to claim 1, which further comprises a shielding hood of said second switching contact piece, said shielding hood having an opening being blocked by said fluid flow guiding device in a contact-connected state of said switching contact pieces.

13. The electrical switching device according to claim 1, wherein said first switching contact piece has an erosion-resistant region being free of radial overlapping by said fluid flow guiding device.

14. The electrical switching device according to claim 1, wherein said switching contact pieces have end sides, and said switching contact pieces are displaceable relative to one another with said end sides situated opposite one another.

15. The electrical switching device according to claim 5, wherein said bushing-shaped second switching contact piece has a centering pin in a bushing opening.

* * * * *